US007170018B2

(12) United States Patent
Ilkhanov

(10) Patent No.: US 7,170,018 B2
(45) Date of Patent: Jan. 30, 2007

(54) DIMMER SWITCH

(75) Inventor: Azer Ilkhanov, Brooklyn, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/242,844

(22) Filed: Oct. 5, 2005

(65) Prior Publication Data

US 2006/0108208 A1 May 25, 2006

Related U.S. Application Data

(60) Provisional application No. 60/618,028, filed on Oct. 12, 2004.

(51) Int. Cl.
*H01H 3/00* (2006.01)

(52) U.S. Cl. ..... 200/18; 200/310; 200/1 R; 200/552; 200/329

(58) Field of Classification Search ..... 200/1 R, 200/17 R, 18, 518, 552, 329, 330, 334, 339
See application file for complete search history.

(56) References Cited

U.S. PATENT DOCUMENTS 4,649,323 A 3/1987 Pearlman et al.
5,207,317 A 5/1993 Bryde et al.
5,248,919 A 9/1993 Hanna et al.
D353,798 S 12/1994 Bryde et al.
5,399,940 A 3/1995 Hanna et al.
5,637,930 A 6/1997 Rowen et al.
5,909,087 A 6/1999 Bryde et al.
6,005,308 A 12/1999 Bryde et al.
6,169,377 B1 1/2001 Bryde et al.
6,727,446 B1 * 4/2004 Mayo et al. ..... 200/296
6,891,117 B1 * 5/2005 Gouhl et al. ..... 200/339
6,979,790 B1 * 12/2005 Endres et al. ..... 200/339
7,034,236 B1 * 4/2006 Endres et al. ..... 200/339

* cited by examiner

*Primary Examiner*—Elvin Enad
*Assistant Examiner*—Lheiren Mae A. Anglo
(74) *Attorney, Agent, or Firm*—Paul J. Sutton

(57) ABSTRACT

A switch for adjusting a plurality of states of a load is provided having a large paddle actuator for adjusting a first state of a lightning load and incorporating an integrated rocker switch for adjusting a second state of a lighting load. The switch also comprises a concealed air-gap switch for disconnecting the switch from line phase when the paddle actuator is placed in a disconnect position and connecting the switch to line phase when the paddle actuator is placed in a connect position.

18 Claims, 9 Drawing Sheets

DIMMER SWITCH

This application claims the benefit of the filing date of a provisional application having Ser. No. 60/618,028, which was filed on Oct. 12, 2004.

BACKGROUND OF THE INVENTION

1. Field of the Invention

The present invention relates to a switch device used to control electrical systems and/or devices.

2. Background of the Invention

Switches and controls for electrical systems and devices have been developed that control more than one state of an electrical load or device. While it is now commonplace for devices to control a plurality of states, such as the ON/OFF/DIM/BRIGHT state of a lighting load, the integration of multiple control features in a single device typically requires more complicated manufacturing processes to accommodate the different features. It is desirable, therefore to produce an integrated control device that is simple to manufacture and less expensive to produce.

SUMMARY OF THE INVENTION

The present invention is directed to an integrated dimmer switch having a sub-frame that permits simplified manufacturing and incorporating a concealed power switch. The switch has multiple functions and is capable of controlling the status (e.g. ON/OFF/DIM/BRIGHT) state of an electrical load (e.g. lighting load) connected to the switch and is also capable of disconnecting electrical power phase from the switch by actuating a concealed power switch within the integrated switch device. The switch is characterized by relatively large "paddle" actuator incorporating a dimmer switch along an outer edge of the paddle. The dimmer comprises a rocker assembly to facilitate the control of the status of the load connected to the integrated switch and the power switch is activated or deactivated by placing the paddle actuator in one of two positions.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the Drawings.

DETAILED DESCRIPTION OF THE PREFERRED EMBODIMENT

The dimmer switch of the present invention is characterized by a large paddle actuator having an intensity actuator embedded within its surface. The paddle actuator is biased to a rest position by a first leaf spring formed in a sub-panel below the paddle. A user may press the paddle to overcome the bias and cause the paddle to rotate about a first pivot to a stressed position wherein a ON/OFF switch is actuated. When the paddle is released it returns to the rest position. Thus, the ON/OFF switch is actuated only momentarily; the paddle does not alternate between an ON position and an OFF position; the paddle has a stressed position and an unstressed position.

Similarly, an intensity actuator can rock about a second pivot. The intensity actuator is biased to a rest position by leaf springs formed in the sub-panel. These springs operate to prevent rotation of the intensity actuator about the second pivot in either a clockwise or counter-clockwise direction respectively. A user may press the intensity actuator to overcome the bias of one or the other of the leaf springs to decrease or increase intensity. When the intensity actuator is released, it returns to its rest position. The intensity actuator is located within an opening of the paddle actuator and operates independently of the paddle actuator. The Paddle actuator of the switch of the present invention can also be rotated about the second pivot to a position that actuates a power (an air-gap) switch concealed within the switch.

Figure 1:
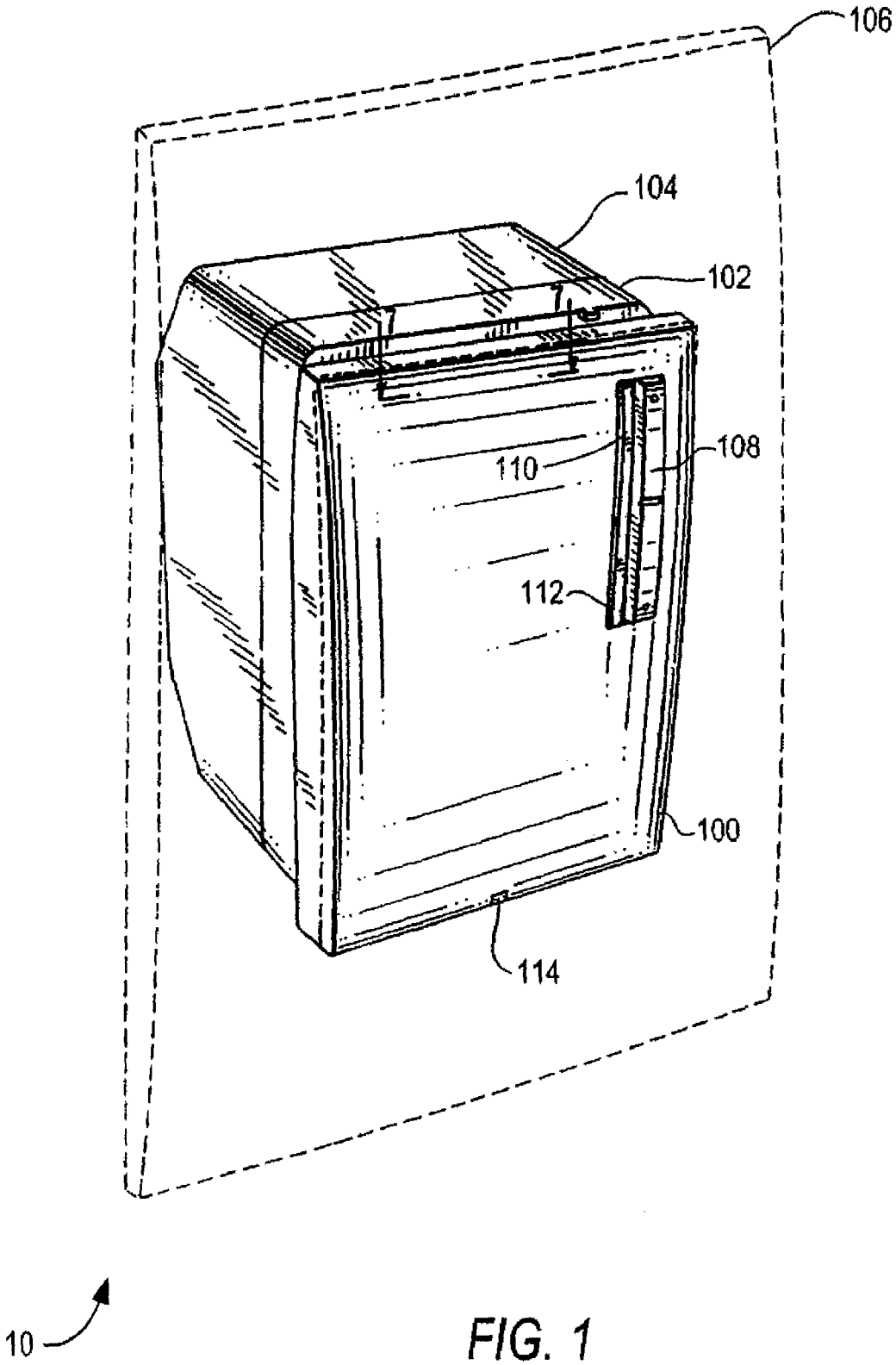
FIG. 1 depicts a dimmer switch in accordance with the present invention.

Referring now to FIG. 1, depicted therein is a switch 10 of the present invention comprising a housing 104, housing cover 102 and paddle actuator 100. The paddle actuator 100 has an opening 112 through which a light pipe 111 and a rocker switch 108 extend. Light pipe 111 has legs 111A, 111B, 111C and 111D. The bottom edge of paddle actuator 100 incorporates a locking tab (not shown) beneath light 114. Light 114 can be implemented with an LED (Light Emitting Diode). The switch 10 is adapted to be installed in conjunction with a faceplate 106 to permit installation of the switch 10 to a wall or other mounting surface.

Figure 2:
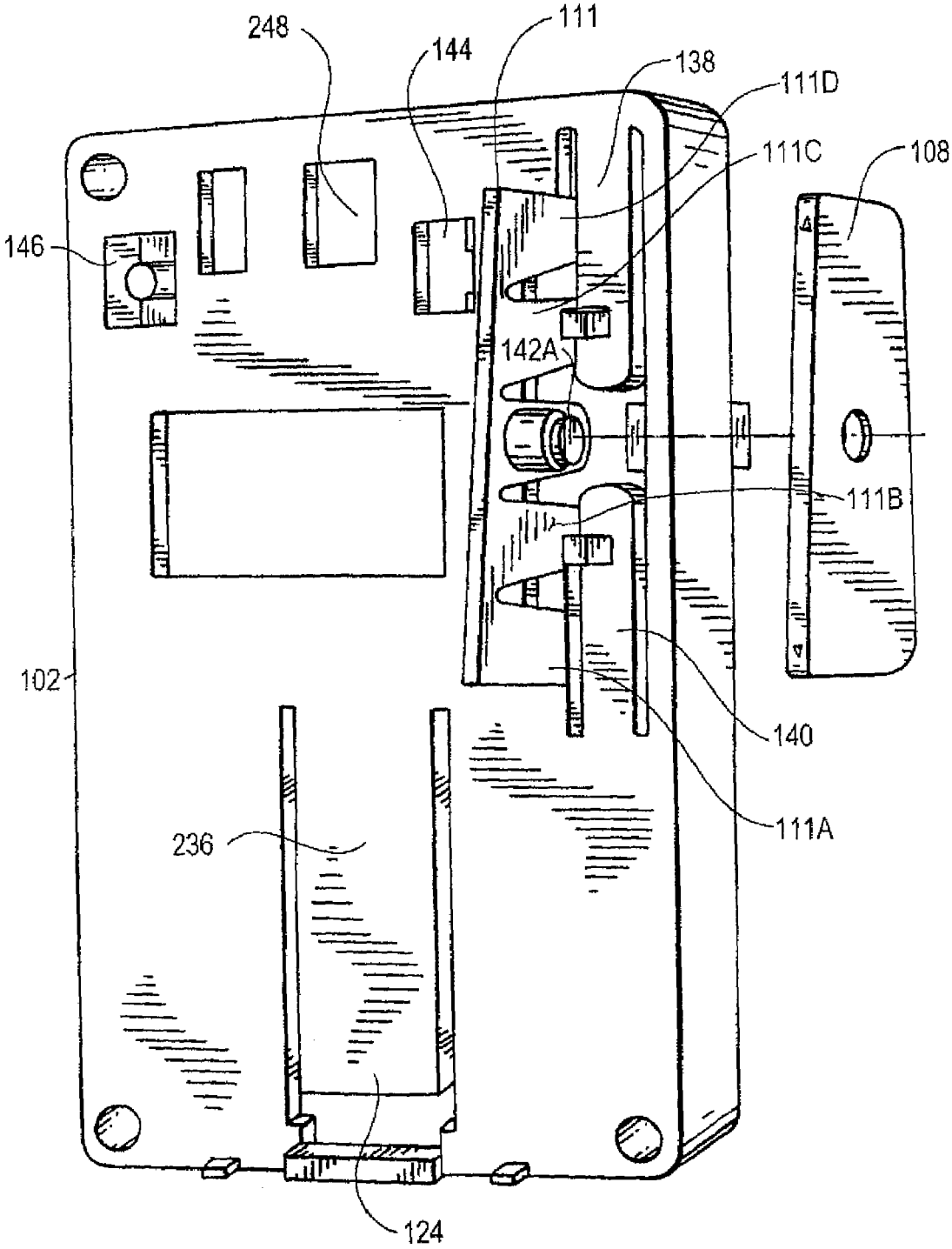
FIG. 2 depicts a housing for the switch of FIG. 1.
Figure 3:
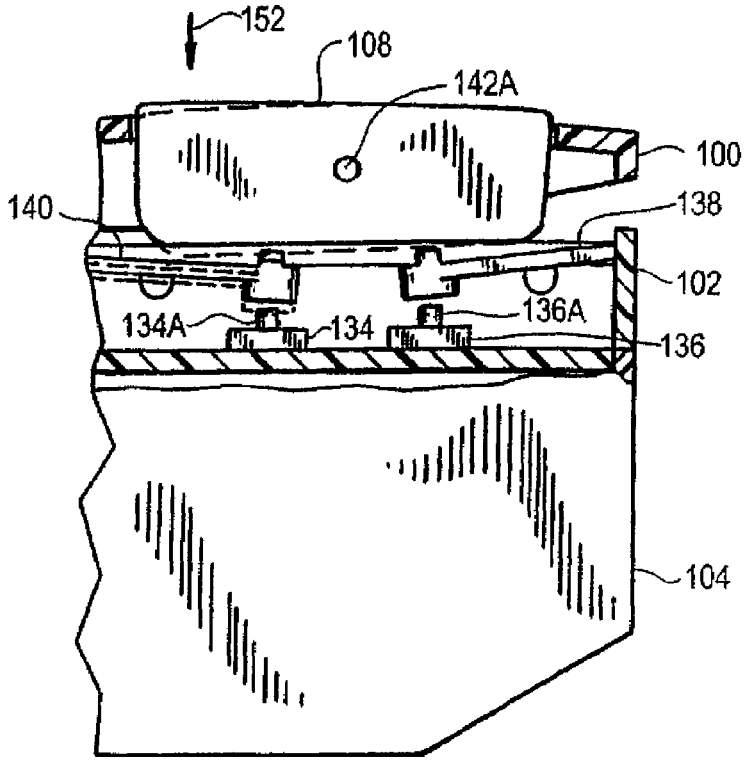
FIG. 3 depicts a dimmer actuator for the switch of FIG. 1.
Figure 4:
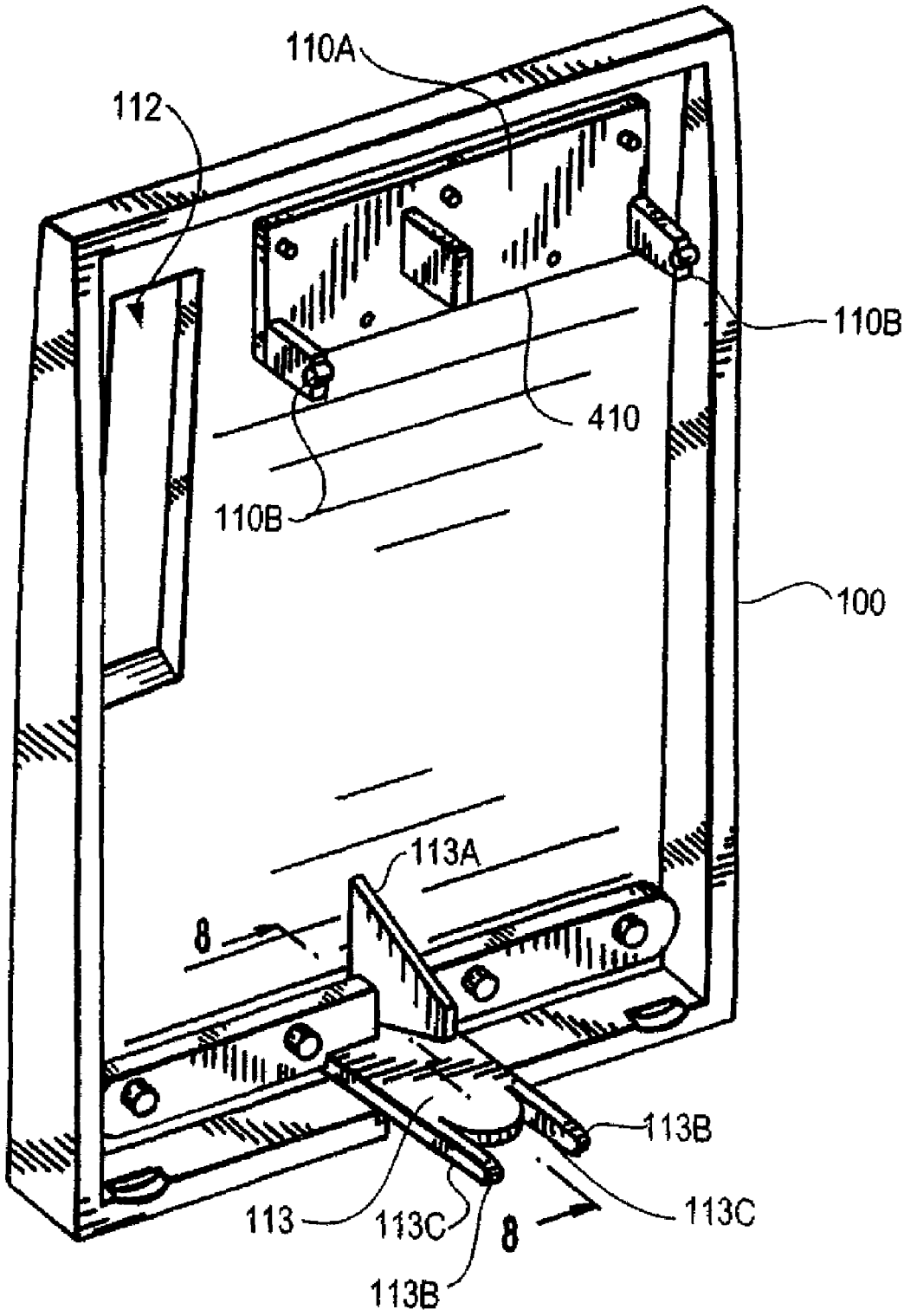
FIG. 4 details an actuating portion of an actuator for the switch of FIG. 1.

Referring now to FIGS. 2 and 3, depicted therein are a top perspective view of housing cover 102 showing the orientation of rocker switch 108. As shown in FIG. 2, housing cover 102 has leaf springs 236, 138, 140 and light pipe 111 formed as an integral part of the housing cover 102. Housing cover 102 also has axle wells 144 and 146 formed within it in which axles 110B of the paddle actuator 100 shown in FIG. 4, are positioned to snap fit into wells 144 and 146, thus coupling the paddle actuator 100 to the housing cover 102. Still referring to FIG. 2, light pipe 111 rises vertically from the surface of housing cover 102 and has a peg 142A extending perpendicularly therefrom. Rocker 108 has an opening through which peg 142A extends when rocker 108 is mounted onto the light pipe 111. Rocker 108 mounted such that it engages with leaf springs 138 and 140 when rotated about peg 142A in a clockwise direction or a counterclockwise direction, respectively.

FIG. 3 shows the interaction of the rocker 108 with leaf springs 138 and 140. As depicted therein, directly positioned on a circuit board underneath leaf springs 138 and 140 are micro switches 134 and 136 which have corresponding spring loaded plungers 134A and 136A respectively. When rocker 108 is depressed so as to rotate in a clockwise direction, it engages leaf spring 138 which in turn pushes down on spring loaded plunger 136A of micro-switch 136 thus activating the microswitch. Upon release of rocker 108, the leaf spring 138 recoils back to its original position allowing the plunger 136A of micro-switch 136 to spring back to its original position. Similarly, when rocker 108 is depressed (in the direction show by arrow 152) so as to rotate in a counterclockwise direction, it engages leaf spring 140 which in turn pushes down on spring loaded plunger 134A of micro-switch 134 thus activating the micro-switch. Upon release of rocker 108, leaf spring 140 recoils back to its original position. The perpendicular peg 142A of light pipe 111, leaf springs 138 and 140, light pipe 111 and micro-switches 136 and 134 constitute a rocker switch arrangement which, when activated, can be used to control the intensity of a light or the relevant speed of a fan or any other similar electrical device and/or system connected to the switch of the present invention.

Referring now to FIG. 4, depicted therein is a perspective view of the back of paddle actuator 100 shown in FIG. 1. As depicted therein, integrally formed on the rear of paddle actuator 100 is power switch actuator tab 410. Note that the power switch (not shown) can be implemented with an air gap switch or any other switch that is able to disconnect a power line from one side of a switch or other device. Hereinafter the power switch will be referred to as an air gap switch. It will be readily understood that the power switch can be implemented with other types of switches and is not limited to the an air-gap switch. Formed on actuator 410 are axles 110B and air gap switch actuating tab 110A. Also formed on paddle actuator 100 are switch actuating tab 113A and paddle locking tab 113. Paddle locking tab 113 further comprises shaped guide surfaces 113B and 113C respectively.

Figure 5:
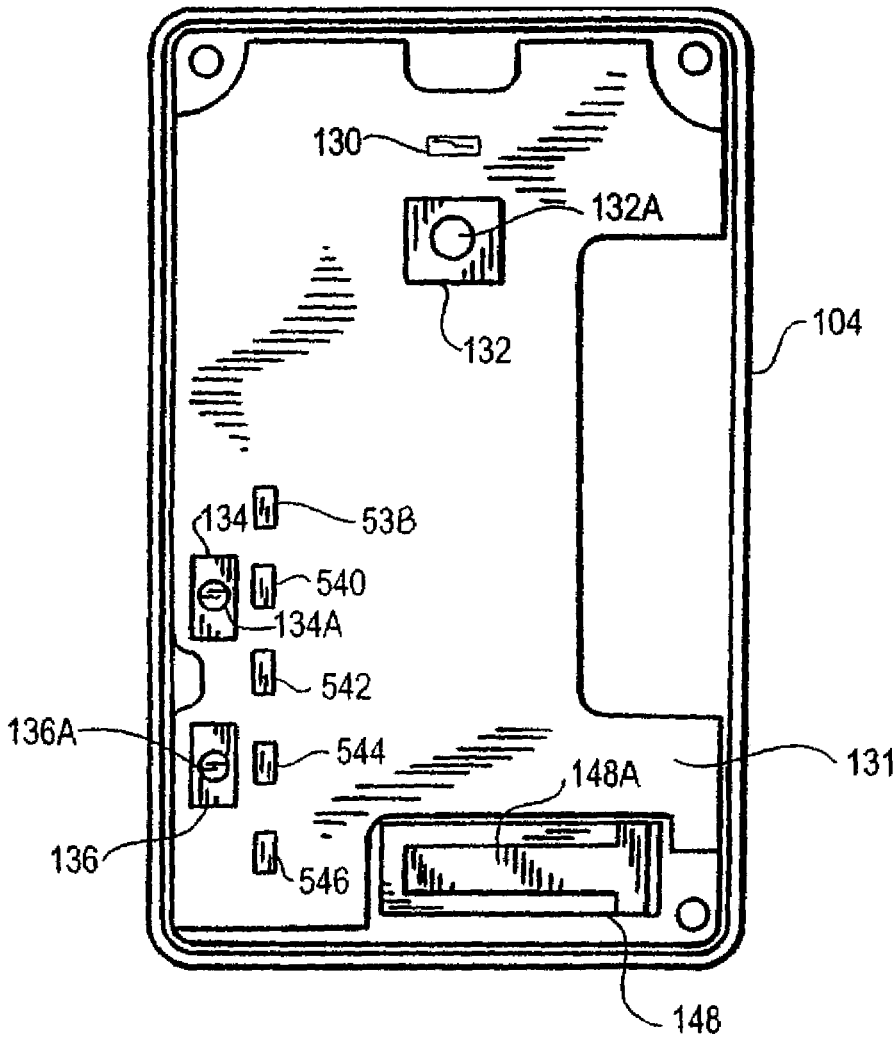
FIG. 5 depicts a circuit board used in the present invention.

Referring now to FIG. 5, depicted therein is a printed circuit board 131 Certain elements of printed circuit board 131 are located to engage with corresponding elements of paddle actuator 100 of FIG. 1 and housing cover 102 of FIG. 2 wherein when assembled, housing cover 102 is sandwiched between paddle actuator 100 and printed circuit board 131. The sub assembly comprising paddle actuator 100, housing cover 102 and circuit board 131 are installed to housing 104 to complete the switch 10 of FIG. 1. As shown in FIG. 5, circuit board 131 comprises micro-switch 132 having a spring-loaded plunger 132A. The power switch implemented with the preferred embodiment is an air-gap switch 148 having a spring loaded lever 148A and is mounted on another printed circuit board (not shown) located underneath printed circuit board 131. Air gap switch 148 extends through a cut out in printed circuit board 131 as shown. Micro-switches 134 and 136 and their corresponding spring-loaded plungers 134A and 136A are located on circuit board 131 and placed to correspond to the placement of leaf springs 138 and 140 of FIG. 2 respectively. LEDs 538, 540, 542, 544 and 546 are placed to correspond to the locations of the legs of light pipe 111 such that when housing cover 102 and circuit board 131 are cooperatively assembled, each of LEDs 538, 540,542, 544 and 546 are located directly beneath a corresponding leg of light pipe 111.

Referring back to FIG. 2, the housing cover 102 has an opening 248 through which the actuator tab 110A of the air gap actuator 410 (See FIG. 4) extends to engage with air gap switch 148 when cover 102 is mated with paddle actuator 100 and circuit board 131.

Figure 6:
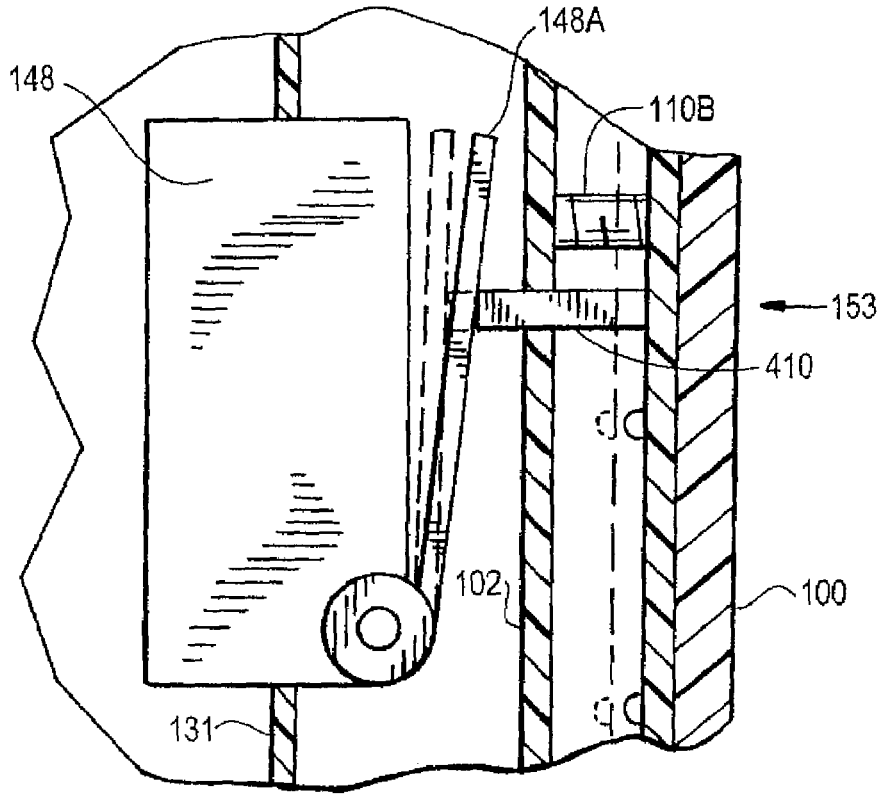
FIG. 6 details actuation of an power/disengagement switch used in the present invention.

FIG. 6 details a portion of the switch of the present invention and shows the cooperative assembly of cover paddle 100, housing cover 102 and printed circuit board 131 with respect to the actuation of air gap switch 148. As depicted therein, when paddle actuator 100, housing cover 102 and circuit board 131 are cooperatively assembled the air gap actuating tab 110A of air gap actuator 410 extends through opening 248 of housing cover 102 and makes contact with spring-loaded lever 148A of air gap switch 148. In operation of the switch 10 of the present invention, pressing paddle actuator 100 in the direction shown by arrow 153 in and thereby actuator 410 in the direction of the arrow establishes positive contact between actuator tab 110A and lever 148A, opens the air gap switch 148 and interrupts connection of the switch 10 to line phase (not shown) or electric power. Similarly, paddle actuator 100, and in turn, cover actuator 410 can be pulled from lever 148A in a direction opposite of that shown by arrow 153 thereby allowing lever 148A to close air-gap switch 148, thereby connecting switch 10 to line phase.

The operation of the air-gap switch can be the reverse of the above description; that is when the paddle is depressed, the air-gap switch connects the power line (not shown) to the switch of the present invention and when paddle 100 is pulled, the air-gap switch disconnects the power from the switch 10 of the present invention.

Figure 7:
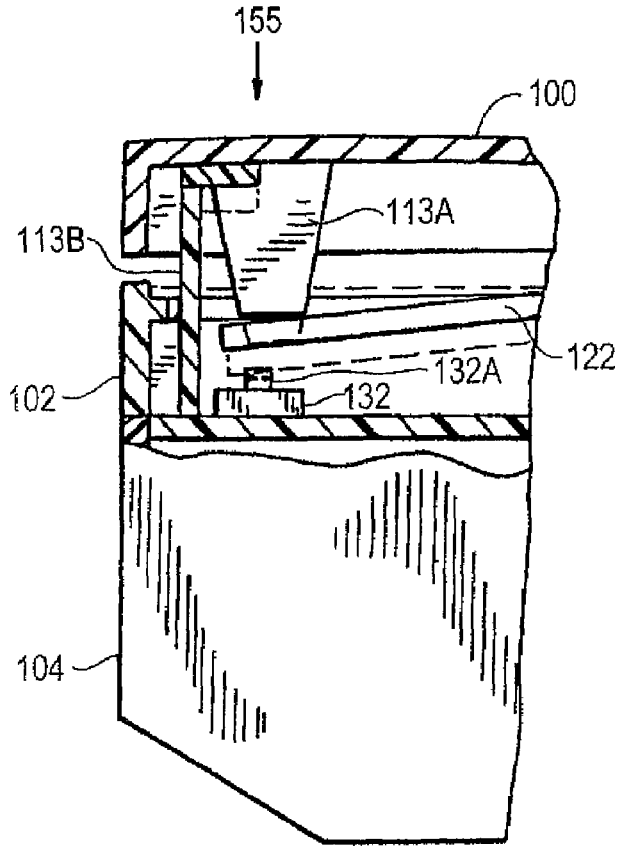
FIG. 7 details actuation of a micro-switch in accordance with the present invention.

When paddle actuator 100, housing cover 102 and circuit board 131 are cooperatively assembled, paddle actuator 100 pivots along axles 110B which are snap-fit into wells 144 and 146. This arrangement brings actuating tab 113A into resilient contact with leaf spring 236 formed in housing cover 102 see FIGS. 2, 4, and 7. Located directly beneath the point of resilient contact between tab 113A and leaf spring 236 is micro-switch 132 and spring loaded plunger 132A; this arrangement is depicted in FIG. 7. Referring to FIG. 7, if paddle actuator 100 is depressed in the direction shown by arrow 155, the bias in leaf spring 236 is overcome and leaf spring 236 is brought into contact with plunger 132A of micro-switch 132. In operation of the switch 10 shown in FIG. 1 this action changes the state of a load connected to switch 10 from OFF to on or vice-versa.

Figure 8:
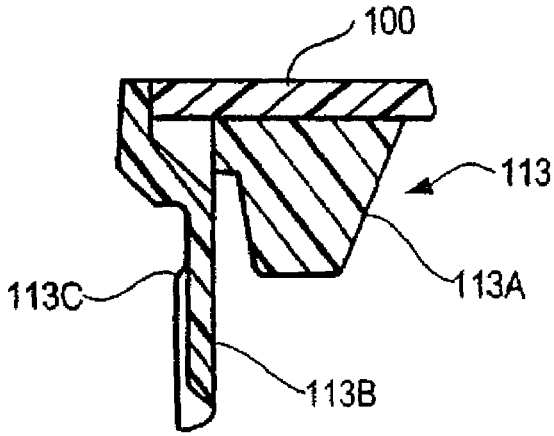
FIG. 8 details an actuator used in the present invention.
Figure 10:
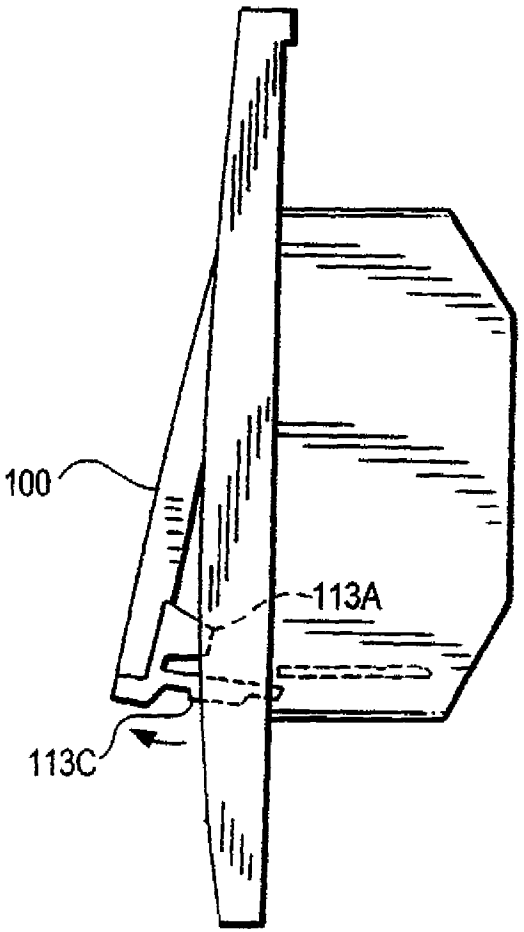
FIG. 10 depicts the dimmer switch of the present invention with the power switch disengaged.
Figure 9:
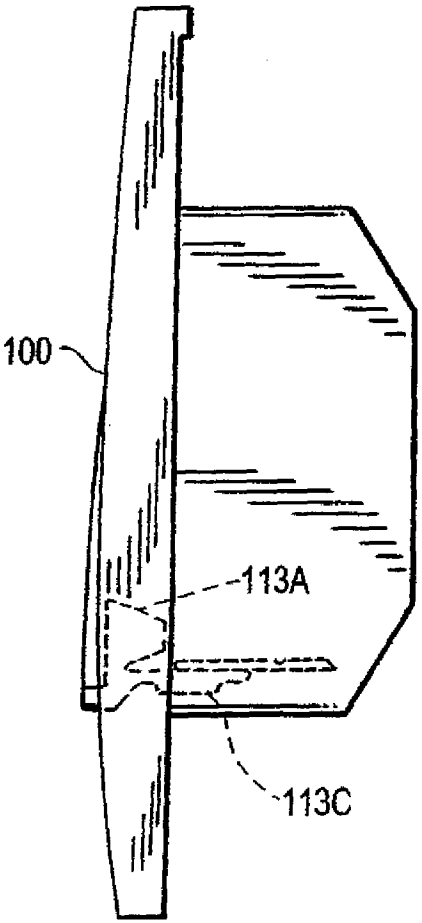
FIG. 9 depicts the switch of the present invention with the power switch engaged.

Referring now to FIG. 8, depicted therein is a detail of a portion of paddle actuator 100. As shown in FIG. 4, paddle actuator 100 comprises actuator tab 113A, locking tab 113 and surfaces 113B and 113C. FIG. 8 is a detail of actuator tab 113A, tab 113 and surfaces 113B and 113C. As shown un FIG. 7, actuator 113A engages spring 236 to actuate switch 132. As shown in FIG. 8, adjacent to actuator 113A is locking surface 113C. With reference to FIG. 9 when cover 100 is in the rest position locking surface 113C and tab 113 are inserted in opening 123 (See FIG. 2) of housing cover 102 whereby locking surface 113C resiliently engages tab 124 of cover 102 (see FIG. 2) to retain cover 100 in place for normal switch operation. The sloping ramp configuration of locking surface 113C permits retraction of tab 113 and surface 113C from opening 123 when sufficient force is applied to the bottom portion of cover 100, as shown in FIG. 10. Still referring to FIG. 10, when the bottom portion of cover 100 is pulled in the direction of the arrow by a user, it disengages surface 113C from tab 124 and rotates cover 100 upward and pivots the top portion of cover 100 around axles 110B. The pivot action permits air-gap actuator 410 (see FIG. 6) to contact lever 148A of air-gap switch 148 and thereby disengaging line phase from switch 10 as described above in the discussion of FIG. 6. The extent to which cover 100 can be pulled out is restricted by the extent to which the upper extent of cover 100 can rotate with respect to housing 102 i.e., when the upper part of cover 100 comes into contact with the upper portion of housing 102 cover 100 cannot rotate any further.

While there have been shown and described and pointed out the fundamental novel features of the invention as applied to the preferred embodiment, as it presently contemplated for carrying them out, it will be understood that various omissions and substitutions and changes of the form and details of the device illustrated and in its operation may be made by those skilled in the art, without departing from the spirit of the invention.

What is claimed is:

1. A switch comprising;

a push pad for adjusting a first state of a load connected to said switch;

a rocker actuator for adjusting a second state of a load connected to said switch; and a slide pivot coupled to said push pad wherein said push pad actuates said switch when depressed and disengages said switch from a line phase when pulled at its bottom.

2. The switch according to claim 1 wherein said push pad actuates a micro-switch when depressed.

3. The switch according to claim 1 wherein disengaging said switch comprises actuating an air-gap switch when said push pad is pulled at its bottom.

4. The switch according to claim 1 wherein said rocker activates at least one micro-switch when actuated.

5. The switch according to claim 1 wherein said rocker comprises a light pipe having individual legs.

6. The switch according to claim 5 wherein said individual legs can be placed on LEDs.

7. The switch according to claim 1 wherein said first state is one of an ON and OFF state.

8. The switch according to claim 1 wherein said second state is at least one of a DIM and BRIGHT state.

9. The switch according to claim 1 wherein said rocker actuator is located within said push pad.

10. The switch according to claim 1 wherein said rocker is biased by a pair of leaf springs.

11. A switch for adjusting the state of a load comprising:

a paddle actuator, said paddle actuator adapted to be biased to return to a rest position following actuation from a first position, said paddle actuator being further adapted to adjust a first state of the load connected to the switch;

a rocker actuator, said rocker actuator being adapted to be biased to return to a second rest position and further adapted to adjust a second state of the load connected to the switch when said rocker actuator is actuated by a user; and a disconnect switch adapted to disconnect the switch from line phase when actuated and wherein when said paddle actuator is actuated by a user in said first position said first state of said load is adjusted and said paddle actuator is biased to return to said rest position and wherein when said paddle actuator is placed in a second position said disconnect switch is actuated thereby disconnecting the switch from said line phase.

12. The switch according to claim 11 wherein said rocker actuator further comprises a light pipe with individual legs.

13. The switch according to claim 11 wherein said individual legs of said light pipe are located adjacent to corresponding LEDs.

14. The switch according to claim 11 wherein said paddle actuator is biased by a leaf spring.

15. The switch according to claim 11 wherein said rocker actuator is biased by a pair of leaf springs.

16. The switch according to claim 11 wherein said first state is one of an OFF and ON state.

17. The switch according to claim 11 wherein said second state is one of a DIM and BRIGHT state.

18. The switch according to claim 11 wherein said disconnect switch is an air-gap switch.

* * * * *